US009614316B2

(12) United States Patent
Li

(10) Patent No.: US 9,614,316 B2
(45) Date of Patent: Apr. 4, 2017

(54) TAMPER RESISTANT RECEPTACLE WITH PROPELLER SHUTTER

(71) Applicant: Hubbell Incorporated, Shelton, CT (US)

(72) Inventor: Jian Hua Li, Bayside, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/743,523

(22) Filed: Jun. 18, 2015

(65) Prior Publication Data

US 2015/0372410 A1 Dec. 24, 2015

Related U.S. Application Data

(60) Provisional application No. 62/015,040, filed on Jun. 20, 2014.

(51) Int. Cl.
*H01R 13/44* (2006.01)
*H01R 13/453* (2006.01)

(52) U.S. Cl.
CPC ..... *H01R 13/4532* (2013.01)

(58) Field of Classification Search
CPC ..... H01R 13/4532
See application file for complete search history.

(56) References Cited

U.S. PATENT DOCUMENTS 3,233,204 A * 2/1966 Vore, Jr. ..... H01R 13/4532 439/159
8,360,791 B2 * 1/2013 Shin ..... H01R 13/4532 439/137

FOREIGN PATENT DOCUMENTS

DE 1298763 A2 * 4/2003 ..... H01R 13/4532
FR 2886775 A1 * 12/2006 ..... H01R 13/4532

* cited by examiner

*Primary Examiner* — Tho D Ta
(74) *Attorney, Agent, or Firm* — Michael Best & Friedrich, LLP

(57) ABSTRACT

A tamper resistant receptacle having a propeller shutter assembly comprising a propeller shutter comprising a central hub with an annual opening, a pair of radially extending arms, and a wing block disposed on the end of each arm. The shutter assembly also includes an anchor for attaching the propeller to the receptacle body and a spring member to bias the propeller in the "closed" position. The wing blocks are sized to block a respect one of the hot and neutral openings of a standard 15-amp electrical receptacle. The wing blocks each include a ramp or inclined cam surface. These surfaces are juxtaposed such that when a plug blade hit one surface and cams past it to cause rotation of the propeller, the opposite plug blade cams down and past the other surface to cause rotation of the propeller in the same direction. This configuration causes the propeller to translate vertical force from the plug blades into rotational force in a direction and of sufficient force to overcome the spring bias of the spring and rotate the propeller wing block out of the way of the electrical contacts such that the blades can "plug in" to the device's electrical contacts.

9 Claims, 8 Drawing Sheets

TAMPER RESISTANT RECEPTACLE WITH PROPELLER SHUTTER

CROSS REFERENCE TO RELATED APPLICATIONS

The present application claims the benefit of priority under 35 U.S.C. 102(e) to U.S. Provisional No. 62/015,040, filed Jun. 20, 2014, the contents of which are hereby incorporated by reference in their entirety.

FIELD OF THE INVENTION

The present invention relates to tamper resistant electrical receptacles. More particularly, the present invention relates to tamper resistant electrical receptacles using a pivoting shutter mechanism spring biased to block access to the receptacle's electrical contacts.

BACKGROUND OF THE INVENTION

Tamper resistant receptacles are known in the art. "Tamper Resistant" or "TR" receptacles refers to a type of electrical wiring device, such as a household duplex electrical receptacle, equipped with means for physically blocking access to the electrical contacts which lie below the hot and neutral plug blade openings in the faceplate of the receptacle unless simultaneous force is exerted upon both the hot and neutral plug blade openings at the same time. Currently, NEC Code 406.11 et seq. and other regulatory requirements provide that not only must the outlet openings remain blocked unless force is applied to both openings at the same time, but also that any foreign object 1/32 inch or larger, must be prevented from bypassing the blocking member of a plug opening. All new construction and major renovations are mandated to by code to use TR receptacles.

As will be appreciated, these code requirements were enacted in response to the all-to-often tragic phenomena of a curious child inserting a conductive material, such as a paper clip or small toy, into either the hot or neutral plug blade opening of a receptacle faceplate and contacting the live hot or neutral electrical contact resulting in electrical shock, burns, or even death.

In meeting the code standard and providing the level of protection sought from these devices, the art has gravitated towards a configuration of receptacles utilizing cooperating shutter members to block access beyond the faceplate openings of the outlet. Specifically, to ensure that force directed into only one of the two blade openings is prevented from reaching the electrical contact that lies beneath, a sliding shutter mechanism is spring-biased into a position blocking (or "shuttering") the blade opening from underneath the faceplate. The shutter physically prevents an object entering the blade opening from reaching the electrical contact below that shutter. In order to allow the shutter of a respective blade opening to be uncovered, the spring-bias must be overcome by a camming action caused by the other plug blade during insertion in the other blade opening.

To this end, the most common prior art configuration of a TR receptacle includes a shutter assembly comprising a pair of cooperating shutters. Each of the shutters includes a blocking portion positioned below a respective one of the blade openings blocking access to the contacts. Each of the shutters also includes a cam portion that extends to the opposite blade opening that receives contact from a plug blade and translates the vertical force of a plug blade and camming action into a lateral sliding displacement of the blocking portion. Thus, force by vertical insertion of a plug-blade on the neutral blade opening will move the shutter from obstructing access to the electrical contact below the hot blade opening, and vice versa. Specifically, for example, during insertion of a plug, the neutral blade tine will cam against and past the shutter cam surface forcing the shutter cam arm to move laterally, thereby overcoming the spring bias of the shutter and causing the hot blade shutter blocking portion to slide into a position away from and revealing the electrical contact beneath the hot blade opening. Likewise, force on the hot blade opening will contact the cam surface and allow the blade to cam past and move the arm and compress the spring to move the shutter blocking portion that covers the neutral blade opening out of the way. As will be appreciated, with this configuration, when a child tries to insert a toy into either opening of the outlet, the blocking portion of the shutter remains immobile from the spring bias of the opposite shutter and prevents the child from reaching the electrical contact. However, when both blades of an electrical plug contact the shutters simultaneously, the simultaneous force and camming action allows both blades to continue their downward insertion by simultaneously sliding respective shutter blocking portions laterally out of the way of the electrical contacts of the opposite shutter until the blades cam past the shutters and are able to properly "plug in" to the outlet's internal face contacts.

Existing prior art TR receptacle designs and their operational details are available in U.S. Pat. No. 4,379,607 to Bowden, Jr.; U.S. Pat. No. 7,645,148 to Carbone et al.; and U.S. Publ. No. 2013/0295788 to Baldwin, et al. and the references cited therein.

The proliferation of these important safety devices has led to an appreciation of the issues affecting their effective life span and cost. A presently appreciated issue recognized by the present inventor stems from the translation of the vertical force of the plug blade into lateral movement of the shutters. In most prior art shutter assemblies, there is no way to use the combined force of the insertion plug blades to overcome a spring bias. Rather, each plug blade opening and shutter operates against its own spring bias independently. Over time, the point of contact for the plug blades on each shutter may deform to the point that so much additional force is needed to slide the shutter open that the device is no longer deemed operable. Another issue appreciated by the present inventor stems from realization that most prior art receptacles need to use a shutter housing component with mounted pairs of shutter members arranged therein to effectuate the safety features of the sliding shutters. Having to deploy an entire sub-housing beneath the faceplate of an outlet may be a significant cost increase.

The foregoing underscores some of the problems associated with conventional TR receptacles. Furthermore, the foregoing highlights the long-felt, yet unresolved need in the art for a TR receptacle that may extend the useful life of the device. Moreover, the forgoing highlights the long-felt, yet unresolved need in the art for a TR receptacle that has an extended service life at a reasonable cost by using fewer and uncomplicated constituent parts.

SUMMARY OF THE INVENTION

Various embodiments of the present invention overcome various of the aforementioned and other disadvantages associated with prior art TR receptacles and offers new advantages as well. Although not wishing to be bound by theory, the present inventor recognizes that by removing the shutter housing and cooperating shutters and replacing them with a unitary propeller shutter may provide a more frictionally advantageous configuration, may extend the service life of some TR receptacles, and may result in a more cost-effective product.

According to one aspect of various embodiments of the present invention there is provided a TR receptacle having a propeller shutter assembly. In accordance with this aspect of the invention, a presently preferred embodiment of the propeller shutter assembly comprises a propeller shutter comprising a central hub with an annual opening, a pair of radially extending arms, and a wing block disposed on the end of each arm. The shutter assembly also includes an anchor for attaching the propeller to the receptacle body and a spring member to bias the propeller in the "closed" position.

In a preferred embodiment, the barbed anchor includes a stem which extends through the annular opening of the propeller shutter to secure the propeller in operational attachment with the rear surface of the receptacle's front cover. A presently preferred embodiment of a spring member comprises a torsion spring. According to this embodiment, the torsion spring is operatively secured on one end by a spring pole disposed on the rear face of the front cover near one of the blade openings and operatively secured on its second end to the wing block disposed in the area of the other blade opening.

The central hub's annular opening is configured and sized to accept a mounting post therein. The mounting post is disposed on the rear surface of the front cover. Once deployed on the mounting post, the central hub is still able to rotate about the post. The post includes a small central opening. The small opening is sized to accept the stem of the barbed anchor. In operation, the barbed anchor is inserted into the mounting post opening to secure the propeller shutter from becoming dislodged for the post.

The wing blocks are sized to block a respect one of the hot and neutral openings of a standard 15-amp electrical receptacle. The wing blocks each include a ramp or inclined cam surface. These surfaces are juxtaposed such that when a plug blade hit one surface and cams past it to cause rotation of the propeller, the opposite plug blade cams down and past the other surface to cause rotation of the propeller in the same direction. In other words, one rotates the propeller up by sliding down and camming past the wing block, while the other rotates the propeller down by sliding down and camming past its wing block. This configuration causes the propeller to translate vertical force from the plug blades into rotational force in a direction and of sufficient force to overcome the spring bias of the spring and rotate the propeller wing block out of the way of the electrical contacts such that the blades can "plug in" to the device's electrical contacts.

The radially extending arms of the propeller shutter are flexible. To this end, a presently preferred embodiment of the invention utilizes a nylon material of construction. Preferably, the propeller shutter is a unitary piece of nylon. The arms are made flexible in order to achieve the safety desired by the device. Specifically, raised blocking tabs are disposed on rear surface of the back cover at an area adjacent to the top of the ramped cam surface of each wing block. The tabs serve to prevent the propeller shutter from rotating. If a paper clip or the like is forced into the hot blade opening of the receptacle face, it strikes the hot blade wing block. With sufficient force, the hot blade wing block and arm may deflect enough to clear the blocking tab of the hot blade wing block. However, the neutral blade blocking tab will still block the neutral blade wing from being able to rotate. With this configuration, a child cannot accidently insert an object into one of the blade openings and cause rotation of the propeller to unblock the electrical contacts.

However, if both blades of the plug are simultaneously inserted into the plug blade openings, each exerts enough vertical force to cause the propeller arms to bend or flex enough to clear both blocking tabs. Once the blocking tabs are cleared, the vertical force of the blades camming against and causing movement of the wing blocks exerts enough force to overcome the spring bias of the spring and allow the propeller to rotate and unblock the opening.

The blocking tabs comprise ramps oriented such that once a plug is unplugged from the receptacle, the bias of the torsion spring rotates the propeller shutter back towards the closed position and the wing blocks slide along and cam past the ramps to return to the closed position.

In a presently preferred embodiment, the rear wall of the front face also includes guard walls disposed around the outer area of the wing blocks. These guide walls are included to prevent an object 1/32 of an inch from being maneuverable past the wing blocks and reaching the electrical contact underneath.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

Various aspects and advantageous features of the present invention will become more apparent to those of ordinary skill when described in the detailed description of preferred embodiments and reference to the accompany drawing wherein.

DETAILED DESCRIPTION OF A PREFERRED EMBODIMENT

Figure 1:
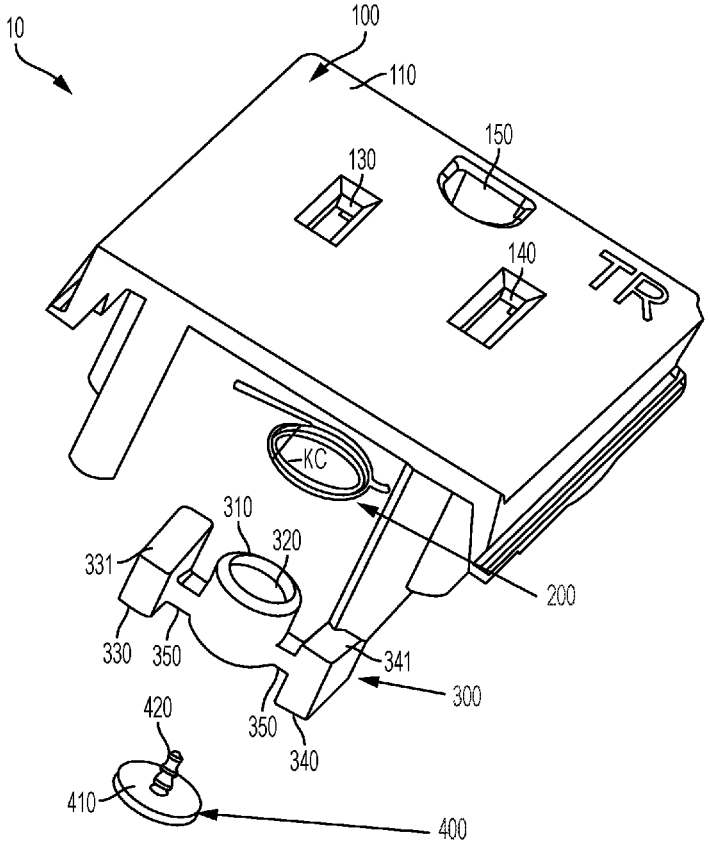
FIG. 1 is a top exploded view of a propeller shutter assembly of a TR receptacle according to an exemplary embodiment of the invention.
Figure 2:
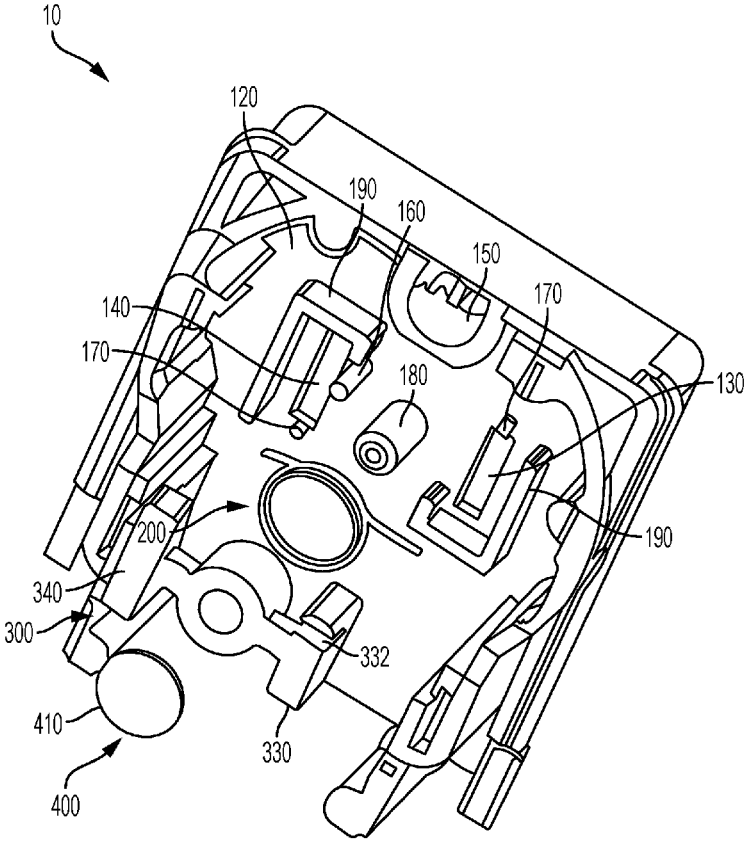
FIG. 2 is a bottom exploded view of the propeller shutter assembly of FIG. 1.
Figure 3:
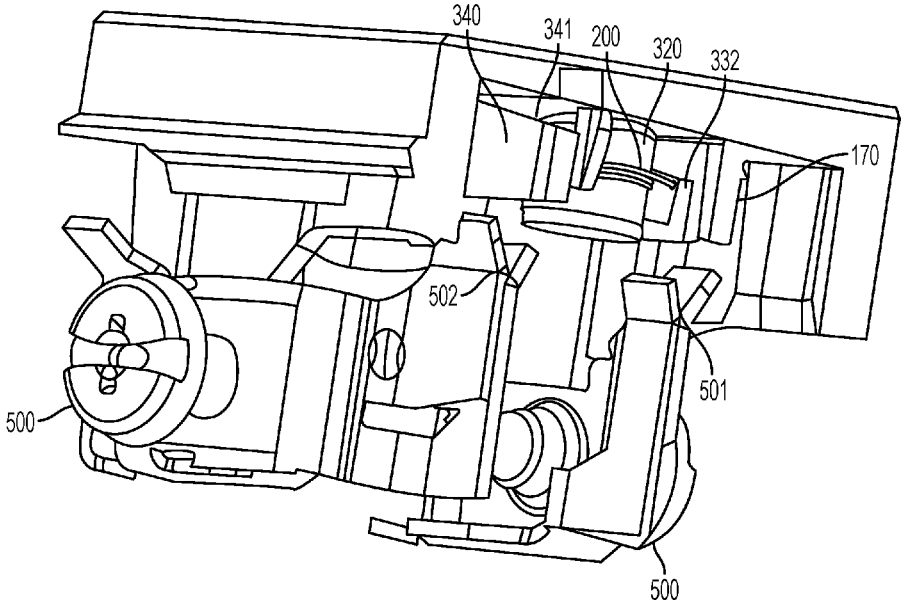
FIG. 3 is a right side prospective view of a propeller shutter assembly of a TR receptacle according to an embodiment of the invention.
Figure 4:
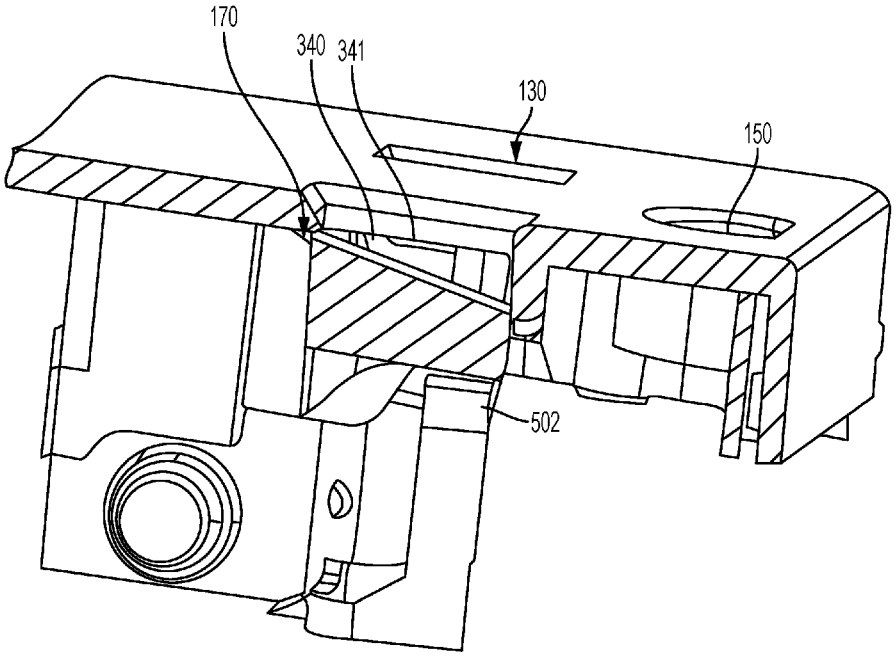
FIG. 4 is a side view in partial cross-section of the shutter assembly disposed on a TR receptacle showing a blade-receiving wing block.
Figure 5:
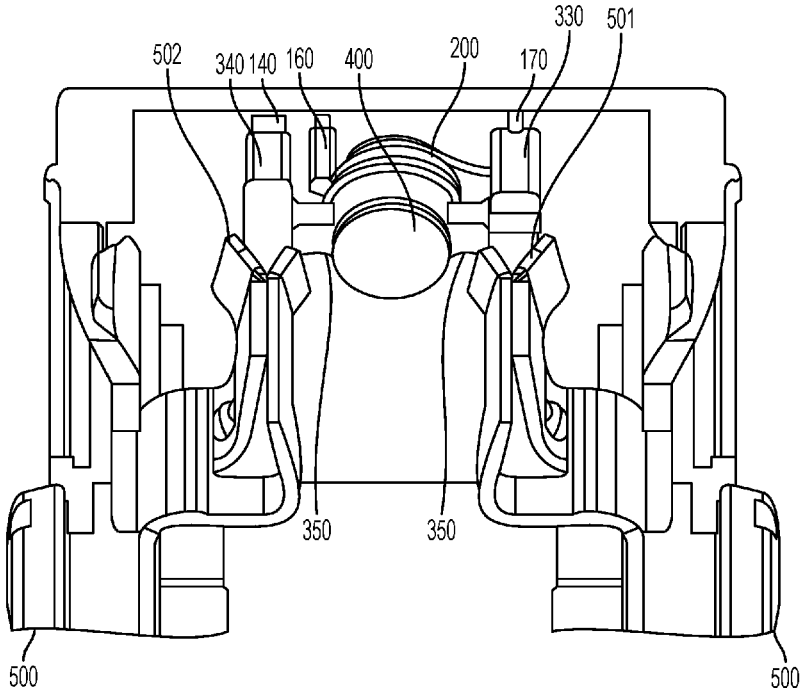
FIG. 5 depicts a bottom perspective view of a propeller shutter assembly of a TR receptacle according to an embodiment of the invention.
Figure 6:
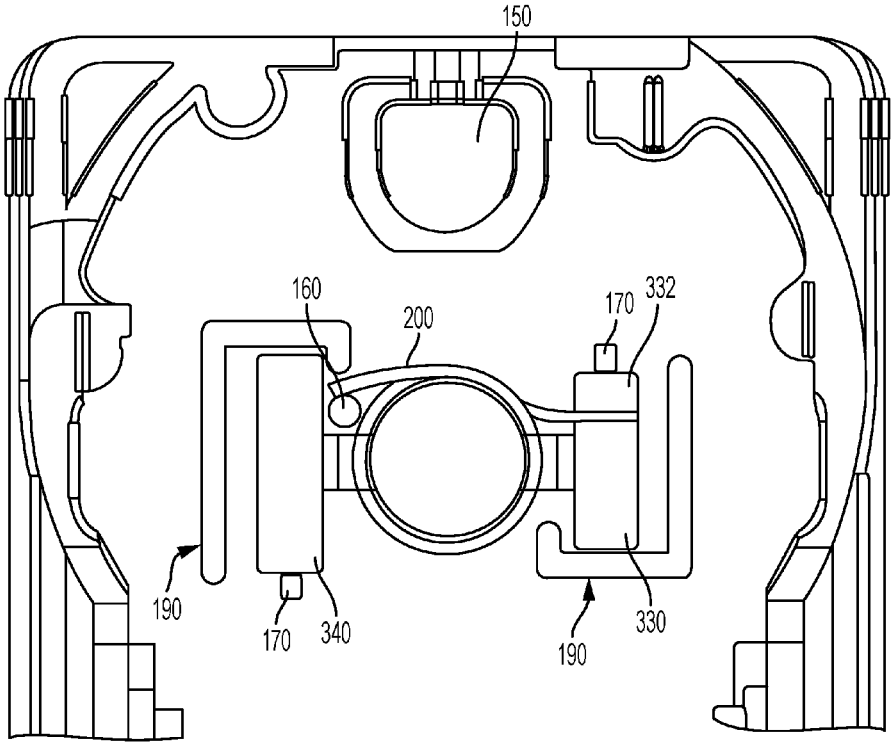
FIG. 6 depicts a bottom view of a shutter assembly of a TR receptacle in the closed position.
Figure 7:
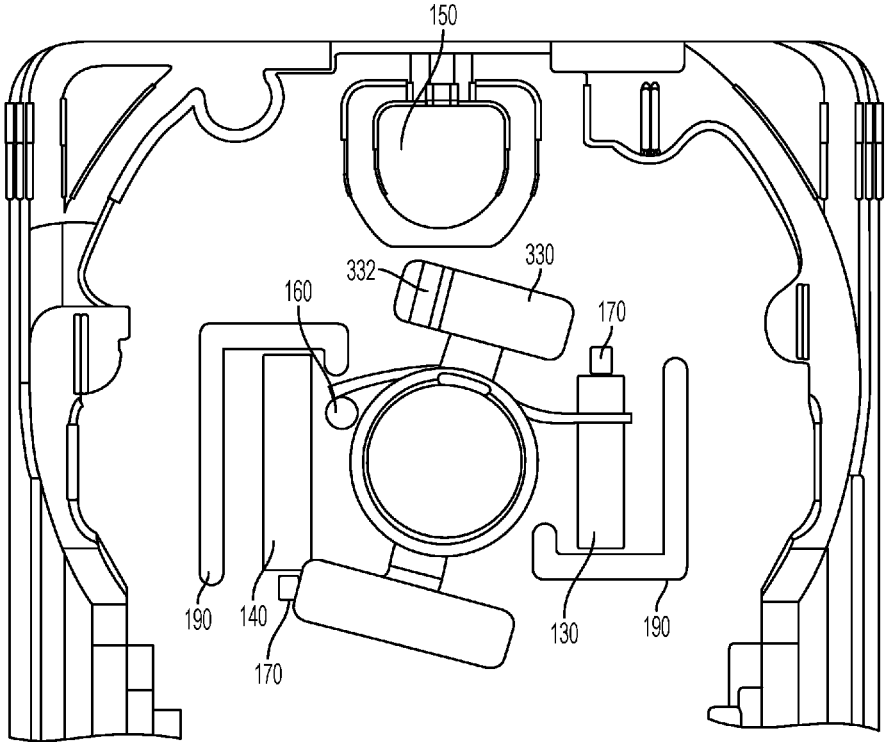
FIG. 7 depicts a bottom view of a shutter assembly of a TR receptacle in the open position.
Figure 8:
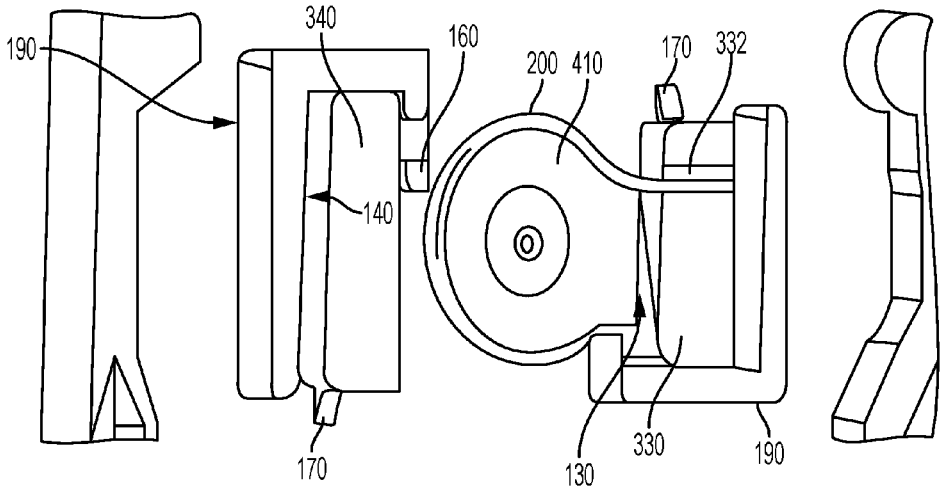
FIG. 8 depicts an isolated view of a shutter assembly components and guard walls in a closed position.

While the present invention will be described in connection with a 15-amp TR receptacle, it will be readily apparent to one of ordinary skill in the art armed with the present specification that the present invention can be applied to a multiplicity of fields and uses. In particular, the present invention may find use in connection with other types of TR receptacles where rotational movement is advantageous. Finally, one of ordinary skill in the art armed with the present specification will also understand that the present system may be easily modified to include different configurations, mechanisms, methods, and kits, which achieve some or all of the purposes of the present invention.

Turning to the Figures, a presently preferred embodiment of a TR receptacle 10 having a propeller shutter assembly is depicted. As shown, the operative components of the receptacle 10 include a faceplate 100 having an outer surface 110 and an inner surface 120. The faceplate 100 includes openings for receiving the male prongs of an electrical plug. Specifically, for the 15 A receptacle depicted, the facelate 100 includes a hot plug blade opening 130, a neutral plug blade opening 140, and a ground prong opening 150. The hot 130 and neutral 140 openings provide a pathway for plug blade tines to reach the hot and neutral electrical conductors 500 of the receptacle.

The tamper resistant features of the present invention include an assembly including a spring member 200, a propeller shutter body 300, and an anchor 400. The propeller shutter 300, comprises a central hub 310 including an annular opening 320. Extending laterally from the hub 310 are a pair of arms 350 on opposite sides of the hub 310. The arms 350 terminate in respective one of the hot wing 330 and a neutral wing 240. The hot wing 330 is sized to block anything from entering the hot blade opening 130 and reaching the hot electrical contact 501. The neutral wing 340 is sized to block anything from entering the neutral blade opening 140 (and thus is longer than the hot block 330) and reaching the neutral electrical contact 502.

In order to establish the blocking wings 330 and 340 in operative position, the propeller shutter uses a spring member 200. The spring member 200 in the depicted embodiment comprises a torsion spring 200; however, one of ordinary skill armed with the present specification will readily appreciate that any suitable arrangement is deemed within the scope of the invention. The spring member 200 on one end is fixed from rotation by a spring pole 160 disposed on the rear face 120 of front cover 100, and on its movable end, is seated in a spring notch 332 of the hot wing block 330. Alternatively, the spring could be connected to the neutral wing 340 instead.

In any event, with this configuration, the wing blocks 330, 340 are spring biased in the "closed" position wherein the hot wing 330 blocks the hot blade opening 130 of the faceplate 100, and the neutral wing 340 blocks the neutral blade opening 140 of the faceplate 100. The only way to access the electrical contacts 500 is to rotate the blocks 330, 340 out of the way by overcoming the spring bias of the torsion spring 200.

The propeller shutter 300 allows the opening of the shutter only upon simultaneous insertion of a hot and neutral plug blade into the hot and neutral openings 130, 140 of the faceplate 100. In the embodiment depicted, to ensure the propeller shutter 300 will only rotate into an "open" position when both the hot and neutral blades are present, the present embodiment uses a propeller body 300 that is secured to the rear face 120 of the faceplate 100 and having flexible arms 350. As shown, a mounting post (bosses) 180 is provided on the rear face 120 of the faceplate 100. The mounting post is configured to be received in the annular opening 320 of the hub 310 of propeller body 300. Once the propeller 300 is positioned on the mounting post 180, an anchor 400 having a head 410 and pin 420 is used to secure the propeller 300 onto the mounting post 180. As shown, the mounting post 180 includes an opening 181 for frictionally receiving the pin 420 of the anchor 400. Once tacked onto the post 180, the head 410 of the anchor 400 prevents the propeller 300 from becoming dislodged from the post 180.

Once operatively secured onto the post 180, the downward force of plug blades hitting the wings 330, 340 of the propeller 300 can be translated into rotational energy to overcome the spring bias of the spring 200 to rotate the propeller into the "open" position. To this end, the hot and neutral wing blocks 330, 340 each are configured with a cooperating sloped, or "cam", surface 331, 341. The sloped surfaces 331, 341 are provided such that when the hot and neutral blades of a plug hit the surfaces 331, 341, the downward force is prevented from going further downward and the tines cam against the sloped surfaces and the blocks overcome the spring bias and begin to rotate. The rotation continues which provides additional depth the blades can be inserted and which continues the rotational movement of the blocks as the blades continue to slide down and cam past the wing blocks until the blocks are rotated out of the way allowing the hot and neutral blades of a plug to "plug in" to the hot and neutral 501, 502 electrical contacts.

Once the plug blades are lifted up to unplug the device, the spring bias of the spring 200 rotates the propeller shutter 300 back to the "closed" position, thereby preventing access to the electrical contacts 500.

In order to ensure that the propeller 300 will only rotate open when simultaneous force is exerted into the plug blade openings and onto the cam surfaces of the wing blocks, the propeller 300 includes flexible arms 350 and stops 170. As discerned from the Figures, stops 170 are positioned in the path of forward rotation of the wing blocks 330, 340. In other words, in order to rotate against the spring bias of the spring 200, the stops 170 must be overcome. The provision of stops 170 in combination with the flexible arms 350 of the propeller 300 ensure that only simultaneous force in the plug blade openings 130, 140 will rotate the propeller shutter 300. Specifically, the downward force of a plug blade will contact a wing block, and if the force is sufficient, force the block's arm 350 to bend downwardly. The flexing of the arm 350 will then bend the arm 350 enough such that the wing block will be able to clear the stop 170 that lies in its rotational path. Importantly, however, both arms 350 must flex at the same time and both stops 170 cleared in order for the propeller 300 to rotate. If force is only exerted into one opening, that arm 350 may flex to a point that the underlying wing block could clear its stop 170; however, the opposite arm still abuts its stop. Accordingly, the propeller will not be able to rotate. Specifically, the stop in the path of the opposite arm prohibits the propeller from rotating. Thus, it is only when force is applied to both openings that both arms flex and allow both wing blocks to clear their stops and rotate open. A presently preferred material of construction includes nylon. However, any suitable material and configuration that allows the arms to flex and return to normal should be understood to be within the scope of the invention.

In order for the propeller shutter 300 to return to the closed position once the blades of a plug are removed from the device, the stops 170 must be cleared again. To this end, the stops 170 of the presently preferred embodiment on wedge shaped. With this configuration, as the propeller 300 rotates back to the closed position, the sloped surface of the stop 170 and the sloped surfaces of the wing blocks 331, 341 glide past each other and the momentum is enough to allow the highest point of the wing blocks to cam past and over the highest point of the stop 170 to return to the closed position.

The above configuration provides a tamper-resistant receptacle that requires simultaneous force on the hot and neutral openings as required by code. In order to prevent a small object from fishing past a wing block, or bending a wing block enough to slide by, a presently preferred embodiment includes guard rails 190 deployed around areas of concern. The guard rails 190 may be integrally formed when molding the faceplate 100. Likewise, the spring pole 160, mounting post 180, and stops 170 deployed on the rear face 120 of the faceplate 100 may be integrally formed with the faceplate 100 during molding. However, alternate arrangements are well within the ability of one of ordinary skill in the art.

The configuration of a TR receptacle using a propeller shutter assembly as described herein should be appreciated in that it provides advantageous features such as allowing the downward force of the plug blades to be combined in overcoming the spring bias of the closure mechanism which may hinder damage to the cam surfaces of the blocking members found with certain independently spring biased shutter mechanisms of the prior art; a easily configurable safety feature that does not require costly or intricate sub-assemblies; and provides a safety feature that is connected directly to the back of the faceplate which may allow for easy and inexpensive replacement of worn parts, retrofitting, kits, and repairs.

Accordingly, one of ordinary skill armed with the present specification will appreciate that the exact dimensions and materials may not be critical to the invention and all suitable variations should be deemed to be within the scope of the invention if deemed suitable for carrying out the objects of the invention.

Likewise, one of ordinary skill in the art will readily appreciate that it is well within the ability of the ordinarily skilled artisan to modify one or more of the constituent parts for carrying out the various embodiments of the invention. Once armed with the present specification, routine experimentation is all that is needed to decide the parameters, materials, and features to adjust for carrying out the present invention.

The above embodiments are for illustrative purposes and are not intended to limit the scope of the invention or the adaptation of the features described herein to particular TR receptacles. Those skilled in the art will also appreciate that various adaptations and modifications of the above-described preferred embodiments can be configured without departing from the scope and spirit of the invention. Therefore, it is to be understood that, within the scope of the appended claims, the invention may be practiced other than as specifically described.

What is claimed is:

1. A tamper resistant receptacle comprising:

a receptacle body having a front cover having a front face defining an outlet area comprising a neutral plug blade opening and a hot plug blade opening;

a propeller shutter assembly comprises a propeller shutter comprising a central hub with an annual opening, a pair of radially extending arms, and a wing block disposed on the end of each arm;

an anchor for attaching the propeller shutter to the receptacle body;

a spring member connected to and biasing the propeller in a closed position whereby the wing blocks of the propeller shutter block the hot and neutral plug blade openings; said wing blocks each include a ramp surface, wherein said ramp surfaces are juxtaposed such that when a first plug blade of an electrical plug hits the ramp surface of one wing block and cams past it to cause rotation of the propeller shutter, a second plug blade of said electrical plug cams down and past the ramp surface of the other wing block to cause rotation of the propeller shutter in the same direction;

whereby if both plug blades of the electrical plug are simultaneously inserted into the hot and neutral plug blade openings, each exerts enough vertical force to cause the propeller shutter arms to bend or flex enough to clear both blocking tabs and whereby the vertical force of the blades camming against and causing movement of the wing blocks exerts enough force to overcome the spring bias of the spring member and allow the propeller shutter to rotate and unblock the blade openings.

2. The tamper resistant receptacle of claim 1, wherein the anchor comprises a barbed anchor including a stem which extends through an annular opening of the propeller shutter to secure the propeller shutter in operational attachment with a rear surface of said front cover.

3. The tamper resistant receptacle of claim 2, wherein said spring member comprises a torsion spring.

4. The tamper resistant receptacle of claim 3, wherein said torsion spring is operatively secured on one end by a spring pole disposed on said rear surface of the front cover near one of the blade openings and operatively secured on its second end to the wing block disposed in the area of the other blade opening.

5. The tamper resistant receptacle of claim 4, wherein said annular opening of said propeller shutter is configured and sized to accept a mounting post therein.

6. The tamper resistant receptacle of claim 5, wherein the mounting post is disposed on the rear surface of the front cover; whereby once deployed on the mounting post, the propeller shutter is still able to rotate about the post.

7. The tamper resistant receptacle of claim 6, wherein the wing blocks are sized to block a respective one of the hot and neutral plug blade openings of a standard 15-amp electrical receptacle.

8. The tamper resistant receptacle of claim 1, wherein the blocking tabs comprise ramps oriented such that once a plug is unplugged from the receptacle, the bias of the torsion spring rotates the propeller shutter back towards the closed position and the wing blocks slide along and cam past the ramps to return to the closed position.

9. The tamper resistant receptacle of claim 8, further comprising guard walls disposed around an outer area of the wing blocks configured to prevent an object 1/32 of an inch from being maneuverable past the wing blocks and reaching the electrical contact underneath.

* * * * *